US005412909A

United States Patent [19]

Wu

[11] Patent Number: 5,412,909

[45] Date of Patent: May 9, 1995

[54] PLASTIC CASING FOR A DOOR FRAME

[76] Inventor: Ming-Hsin Wu, 20, Lane 92, Shing Ell Street, Tao Yuan City, Tao Yuan County, Taiwan, Prov. of China

[21] Appl. No.: 219,175

[22] Filed: Mar. 28, 1994

Related U.S. Application Data

[63] Continuation-in-part of Ser. No. 42,635, Apr. 5, 1993, abandoned.

[51] Int. Cl.[6] ..... E06B 1/04

[52] U.S. Cl. ..... 49/505; 49/460; 52/212

[58] Field of Search ..... 49/505, 460; 52/217, 52/212

[56] References Cited

U.S. PATENT DOCUMENTS

| | | | |
|---|---|---|---|
| 1,266,547 | 5/1918 | Baxter | 49/505 X |
| 2,562,105 | 7/1951 | Lang | 52/212 |
| 2,853,161 | 9/1958 | Mascari | 49/505 X |
| 3,545,135 | 12/1970 | Lieber | 49/505 |
| 3,609,928 | 10/1971 | Mock | 49/505 |
| 3,800,488 | 4/1971 | Swanson | 49/505 |
| 4,467,576 | 8/1984 | Burgers | 49/505 X |
| 4,589,229 | 5/1986 | Warren | 49/505 |
| 5,058,323 | 10/1991 | Gerritsen | 49/460 X |
| 5,187,898 | 2/1993 | McKann | 49/505 |

FOREIGN PATENT DOCUMENTS

| | | | |
|---|---|---|---|
| 466905 | 12/1973 | Australia | 49/505 |
| 2226538 | 11/1974 | France | 49/505 |
| 2242431 | 2/1974 | Germany | 52/212 |
| 2260745 | 6/1974 | Germany | 52/212 |
| 3900608 | 7/1990 | Germany | 49/505 |
| 449218 | 4/1968 | Switzerland | 49/505 |

*Primary Examiner*—Philip C. Kannan
*Attorney, Agent, or Firm*—Bacon & Thomas

[57] ABSTRACT

A design of a structure for plastic casing to cover a door frame, particularly an improved structure and installation method for the replacement of the casing of the door. The structure mainly uses a front slat and a rear slat to fit together so as to cover up the outer layer of the existing old casing on the wall. The width of the structure can be adjusted to the width of the old casing. Nails can be used to feed through the holding slat for positioning and securing, a plastic cap can be used to cover the ends of the front and the rear slats so as to form a completed ornamental casing, thus saving the time and manpower to remove the old casing as well as preventing the damage from the removal of the old casing. In addition, the decorative assembly gives a strong-binding, secure and practical structure of a plastic casing for a door frame.

2 Claims, 4 Drawing Sheets

PLASTIC CASING FOR A DOOR FRAME

BACKGROUND OF THE INVENTION (a) Field of the Invention

The present invention is a continuation in part of a plastic casing for a door frame under Ser. No. 08/042635, filed Apr. 5, 1993, now abandoned, and relates to an improved structure of a plastic casing for a door frame, particularly to an innovative design to the structure and installation method for the casing of a door frame.

(b) Description of the Prior Art

A wood casing is normally secured to an opening of a wall first, then the gaps between the wall and the pieces of the casing are filled with putty or cement, the surface is then sanded to prepare for smoothness before painting, wall papering or decoration. In an area where the moisture is high, the wood casing usually becomes rotten and decayed after a period of time. Occasionally there is a necessity to replace the wood casing and it is not a small job. The old casing needs to be removed first before a new one (wood or plastic) can be installed. Repeating the above installation process is time consuming. In addition, it can cause some damage to the wall decoration during the removal of the old casing, which in return drives up the replacement cost. The waste in material is not economical. Due to the aforesaid disadvantages, several types of structure for the door casing have been developed. They can be grouped into two types. The first type mainly uses a front slat and a rear slat fitted together from the front and the rear sides of the old casing, the old casing and the wall are then covered up by the assembly, which is secured to the wall or the old casing. Such structures include the U.S. Pat. Nos. 2,853,161, 3,545,135, 3,800,488, 4,589,229, 5,187,898 and U.S. Pat. No. 449,218 from Switzerland. Among these patents, the one from Switzerland uses bolts to adjust the front and the rear slats so that the old door casing can be kept straight. However, the structure for that patent requires a lot of components, making it time consuming for the installation. Moreover, the installation is not sound and secured. The overall appearance is also affected by the component 43. In addition, the design of the structure uses the front slat and the rear slat to cover the wall surface and the old casing, which usually has the same width or a little bit wider than the wall surface. Because of this, the new casing of the door becomes wider and the door panel becomes smaller. When the old door casing is narrower than the wall surface, it is hard to install the above-mentioned conventional products. Since the edge of the wall surface may be uneven, which allows gaps to exist in between the new casing and the old casing or wall surface. The dirt and insects are often trapped in the gaps. On the other hand, the second type of the door casing uses an assembled casing to cover the old casing, and the assembled casing is then attached with decorative or ornamental plates or strips. This type includes U.S. Pat. No. 3,609,928, French Patent No. 2,226,538 and Australia Patent No. 466,905. The French Patent No. 2,226,538 has special features among these patents. The door hinges and the locks for that structure are designed to adapt to different positions in the door. However, the structure is designed for new installation in the wall surface only, it is not designed for replacing an existing old casing. Therefore, the structure is more complicated and the application is limited. The conventional door hinges and door locks cannot be used on the structure. In addition, the disadvantage of having the gaps between the wall surface and the new casing also exists in this type of structure. Because of the drawbacks that exist in the different types of structure of the door casing, the present invention provides a new structure for a door casing which can be manufactured from plastics and installed by assembling. The new structure consists of a front slat and a rear slat which can be put together by insertion, so as to cover up the old casing on the wall. No matter how wide the old casing or the wall surface is, the new structure can be adjusted freely to cover it up. When the wall surface of the door casing is uneven, the plastic casing can be positioned on the shallow side, the gaps on the deep side can be hidden by a holding slat. Nails or screws can be applied to the central slot of the holding slat, feeding through the plastic casing so as to secure the assembly onto the old casing. In addition, the holding slat can cooperate with the plastic cap for covering the old casing. The design provides a structure that eliminates the removal of the old casing and prevents the damage caused by such removal. It also seals the gap formed between the surface of the wall and the casing so as to provide a decorative door casing on the wall.

SUMMARY OF THE INVENTION

The main object according to the present invention is to provide a structure of a plastic casing for a door which can be assembled to cover the old casing, thus making the installation simple and eliminating the removal of the old casing. In addition, it also prevents the wall surface from cracking due to the removal of the old casing, thus indirectly saving the material and time during the installation.

Another object according to the present invention is to provide a structure of a plastic casing for a door in which the gaps formed between the wall surface and the casing can be hidden by a holding slat. Nails can be attached to the central slot of the holding slat through the plastic casing to the old casing of the door.

Still another object according to the present invention is to provide a structure of a plastic casing for a door in which the holding slat cooperates with a plastic cap to cover the old casing, so as to give a completed decorative assembly of a door casing.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
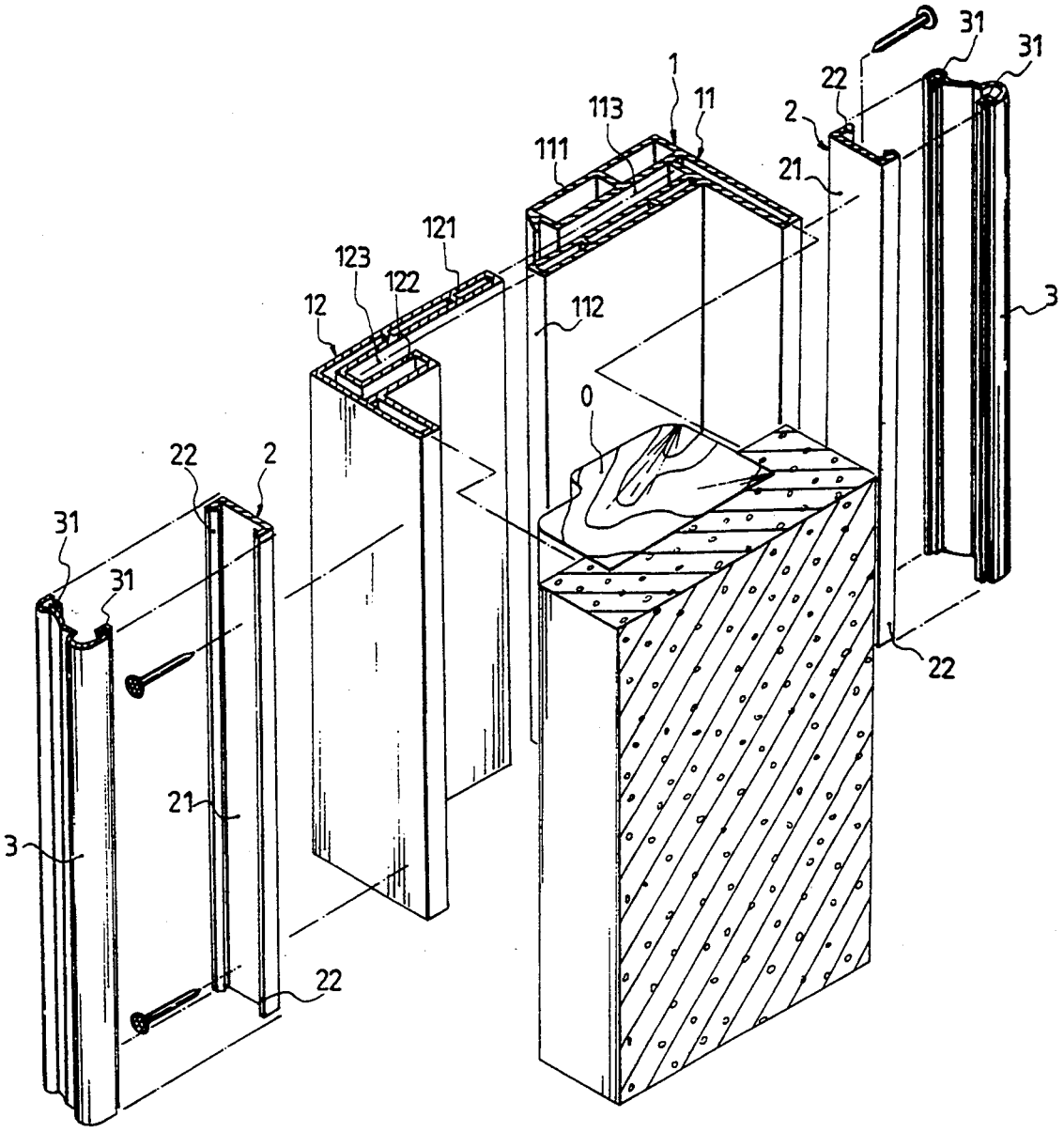
FIG. 1 is a perspective fragmented view according to the present invention.
Figure 2:
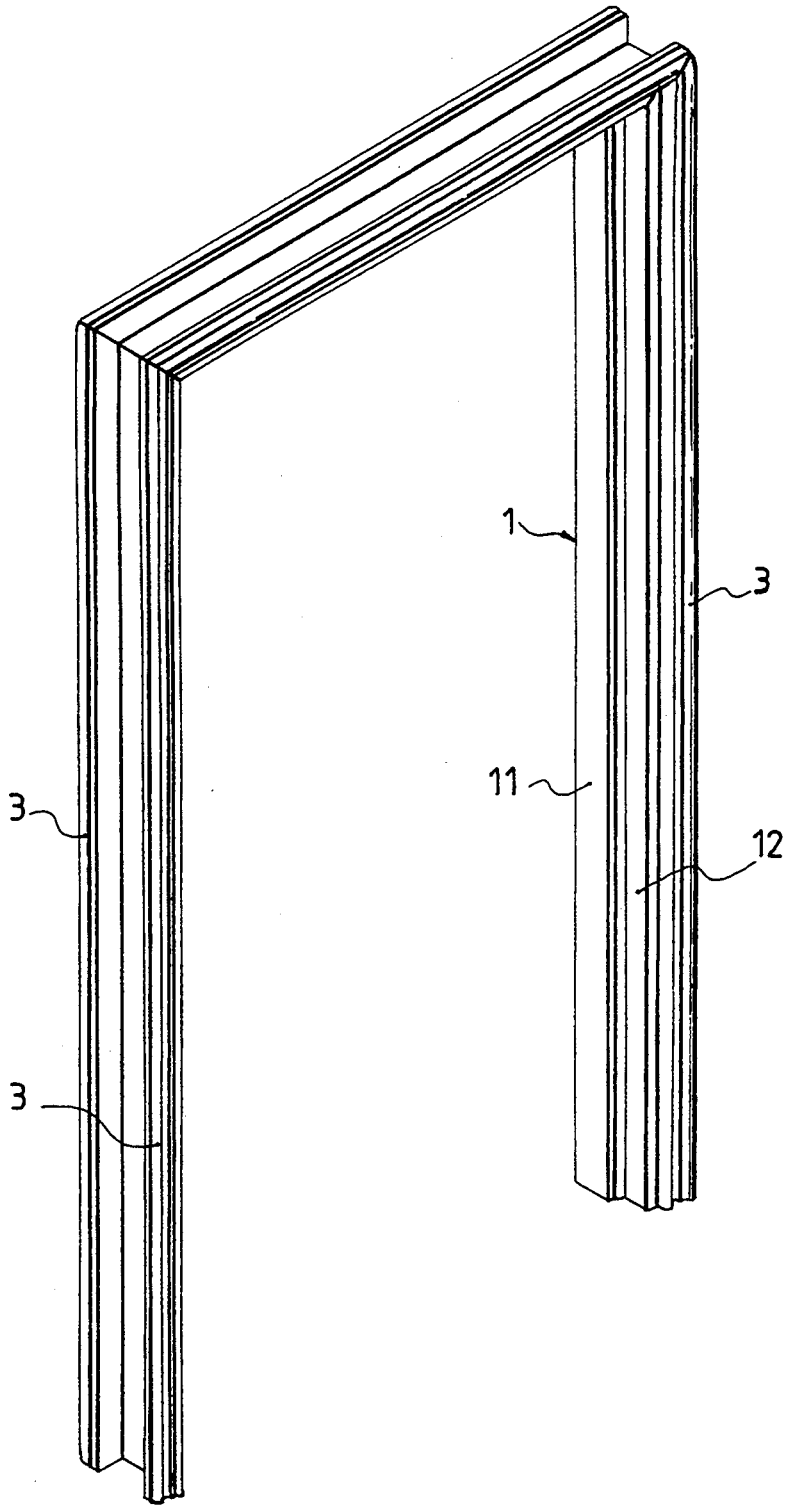
FIG. 2 is a perspective view of the assembly according to the present invention.

As shown in FIGS. 1 and 2, the plastic casing for a door frame according to the present invention has a new structure and installation method for the replacement of the door casing. The structure of the plastic casing 1 according to the present invention mainly consists of a front slat 11 and a rear slat 12, which are assembled together from the front and the rear sides of the old casing 0. A holding slat 2 and a plastic cap 3 are used to complete the installation.

The front slat 11 has a "F" cross section, which consists of an outer panel 111 and an inner panel 112, a groove 113 is formed in between the outer panel 111 and the inner panel 112, and the inner panel 112 is longer than the outer panel 111.

The rear slat 12 also has a "F" cross section, which consists of an outer panel 121 and an inner panel 122. In between the outer panel 121 and the inner panel 122 is a groove 123, which is made for the inner panel 112 of the front slat 11 to fit in, and the thickness of the outer panel 121 is made to fit into the groove 113 of the front slat 11.

The holding slat 2 consists of a slat 21 with two parallel latching plates 22 provided on one side. The top of the latching plates 22 are provided with hooks bending inward so that the hooks can be secured with the plastic cap 3.

The plastic cap 3 is an elongated body for covering. The elongated body of the plastic cap 3 consists of two parallel catching slats 31, which are provided with catches bending outward. The width of the catching slats 31 is made to secure with the hooks of the latching plates 22 of the holding slat 2. In addition, the exterior surface of the plastic cap 3 can be made to have a corrugated pattern to enhance the appearance, as long as the width of the two catching slats 31 cooperates with the latching plates 22 of the holding slat 2.

Figure 3:
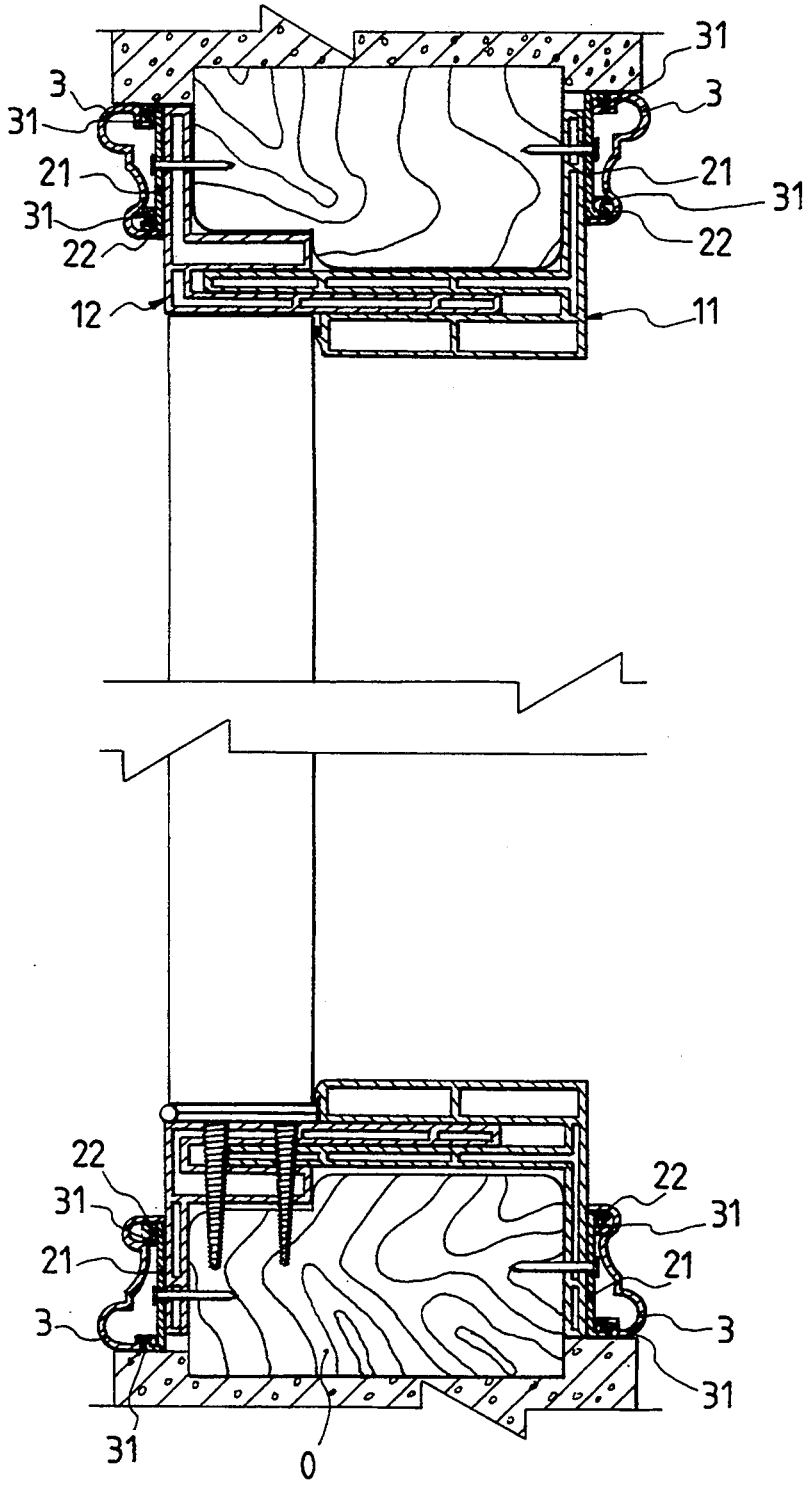
FIG. 3 is a cross sectional view of an embodiment according to the present invention.
Figure 4:
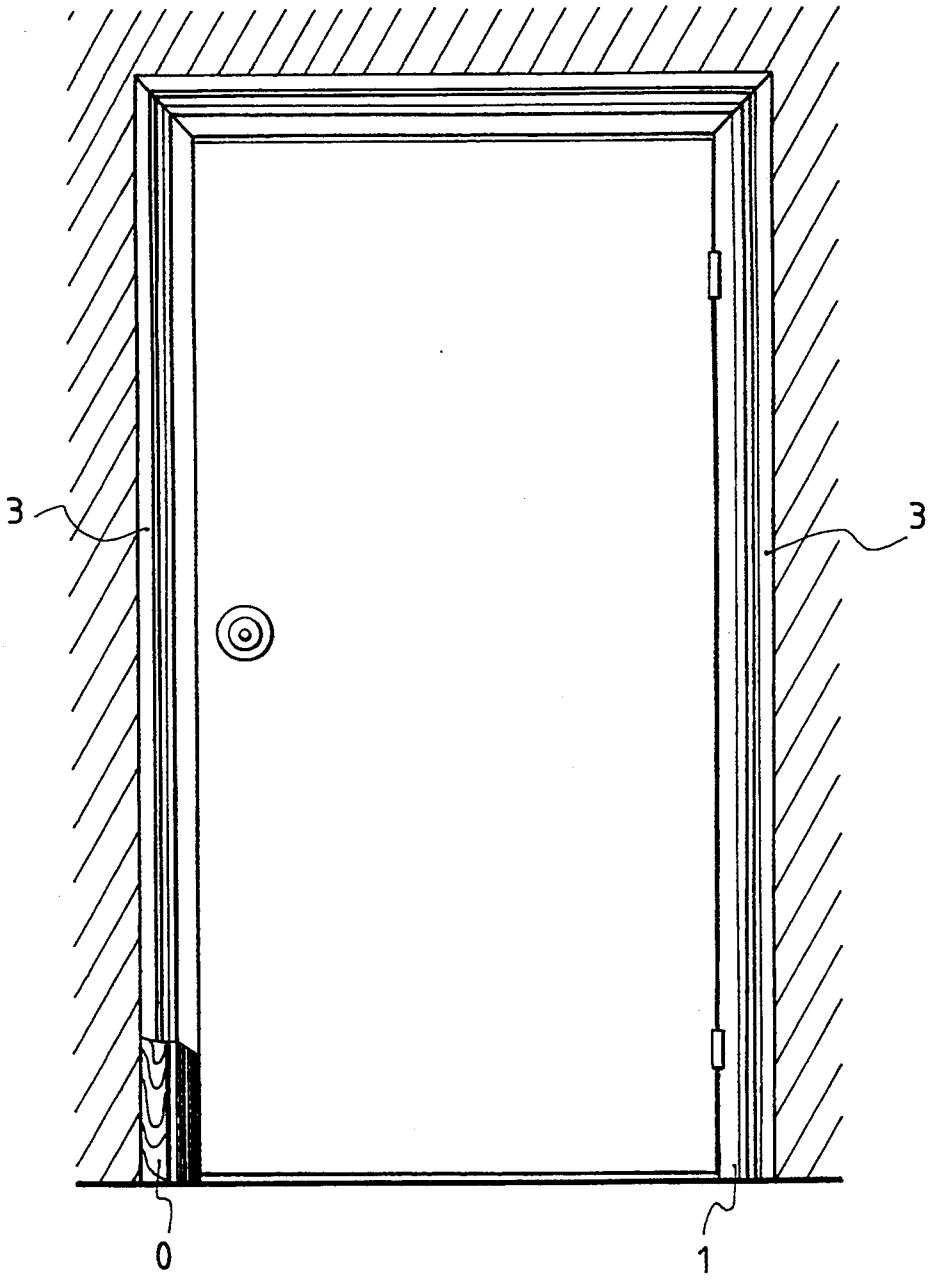
FIG. 4 is an illustrative drawing showing an embodiment of the plastic casing as installed on a door frame.

When the front slat 11 and the rear slat 12 are fabricated appropriately, they can be fitted and assembled together from the front and the rear sides of the old casing 0, forming an assembly in which the outer panel 121 of the rear slat 12 is inserted into the groove 113 of the front slat 11. The inner panel 112 of the front slat is inserted into the groove 123 of the rear slat 12. The overlapping of the front slat 11 and the rear slat 12 can be adjusted freely to match the width of the existing casing 0. Moreover, the projection and width formed by the inner panels 112 and 122 of the front slat 11 and the rear slat 12 are now covering the outer layer of the old casing 0, as is shown in FIG. 3. When the wall surface is not even, the edge of the front slat 11 or the edge of the rear slat 12 of the plastic casing 1 will be positioned on the shallow side on the edge of the wall surface. The holding slat 2 is urged to the wall and the edges of the plastic casing 1, and the gaps formed are then shielded to prevent the build-up of dirt and insects therein. Nails or screws 4 can be applied to the central slot of the holding slat 2, feeding through the slat 21 and the ends of the front slat 11 and the rear slat 12, so as to secure the assembly onto the old casing 0. The plastic cap 3 can be used to cover up the holding slat 2 for decoration purpose, finishing the door casing with an attractive and modern look, as is shown in FIG. 4. This design not only saves the time to remove the old casing of the door frame, but also prevent the damage caused by the removal of the old casing. In addition, the decorative assembly gives a strong-binding, secure and practical structure of a plastic casing for the door opening.

Although the invention has been described in its preferred form with a certain degree of particularity it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exists in the invention disclosed.

What is claimed is:

1. A plastic casing for a door frame configured to fit over an existing door frame and comprising:

a) a first slat having a generally "F" shaped cross sectional configuration with a first base leg, a first outer panel extending from the first base leg and a first inner panel extending from the first base leg and spaced apart from the first outer panel so as to form a first groove therebetween, the first slat positioned against a first side of the existing door frame;

b) a second slat having a generally "F" shaped cross sectional configuration with a second base leg, a second outer panel extending from the second base leg and a second inner panel extending from the second base leg and spaced apart from the second outer panel so as to form a second groove therebetween, the second slat positioned against a second, opposite side of the existing door frame such that the first inner panel extends into the second groove and the second outer panel extends into the first groove;

c) first and second elongated holding slats each having a plurality of elongated latching plates extending therefrom, and positioned such that at least a portion of the first and second elongated holding slats are in contact with one of the first and second base legs;

d) fastening means extending through an elongated holding slat, the corresponding base leg and into the existing door frame; and, e) first and second elongated caps, each cap having a plurality of elongated catching slats configured to releasably engage the plurality of elongated latching plates such that the elongated caps cover the fastening means.

2. The plastic door casing of claim 1 wherein at least one of the elongated caps has a decoratively configured outer surface.

* * * * *